US010512852B2

(12) United States Patent
Fung

(10) Patent No.: US 10,512,852 B2
(45) Date of Patent: Dec. 24, 2019

(54) TOY VEHICLE TRACK SET

(71) Applicant: DONGGUAN SILVERLIT TOYS, CO., LTD., Dongguan (CN)

(72) Inventor: Choi Kei Fung, Causeway Bay (HK)

(73) Assignee: DONGGUAN SILVERLIT TOYS CO., LTD., Dongguan (CN)

( * ) Notice: Subject to any disclaimer, the term of this patent is extended or adjusted under 35 U.S.C. 154(b) by 333 days.

(21) Appl. No.: 15/457,164

(22) Filed: Mar. 13, 2017

(65) Prior Publication Data

US 2018/0256993 A1 Sep. 13, 2018

(51) Int. Cl.
*A63H 18/02* (2006.01)
*A63H 18/04* (2006.01)
*A63H 18/08* (2006.01)

(52) U.S. Cl.
CPC ..... *A63H 18/021* (2013.01); *A63H 18/04* (2013.01); *A63H 18/08* (2013.01)

(58) Field of Classification Search
CPC ..... A63H 18/02; A63H 18/021; A63H 18/04; A63H 18/08
See application file for complete search history.

(56) References Cited

U.S. PATENT DOCUMENTS 4,540,119 A * 9/1985 Neuhierl ..... A63H 19/30 238/10 F
6,382,519 B1 * 5/2002 Choi ..... A63H 18/02 238/10 F
6,631,850 B1 * 10/2003 Wa ..... A63H 18/021 104/60
6,648,237 B2 * 11/2003 Rothkopf ..... A63H 18/02 238/10 B
6,883,720 B2 * 4/2005 D'Angelo, Jr. ..... A63H 18/02 104/61
10,046,246 B2 * 8/2018 Muldoon ..... A63H 19/30
2004/0182947 A1 * 9/2004 Wa ..... A63H 18/021 238/10 R
2005/0176510 A1 * 8/2005 Choi ..... A63F 9/14 463/62
2009/0139424 A1 * 6/2009 Norman ..... A63H 18/021 105/1.5
2018/0071647 A1 * 3/2018 Deutsch ..... A63H 18/021
2018/0256993 A1 * 9/2018 Fung ..... A63H 18/08

* cited by examiner

*Primary Examiner* — Jason C Smith
(74) *Attorney, Agent, or Firm* — Greenberg Traurig, LLP

(57) ABSTRACT

A track for a toy vehicle includes several track units. Each track unit has an upper layer and a spaced apart lower layer. Each of the adjacent units comprises two sections. A first section has an upper side for supporting the toy vehicle and a bottom side. A second section has an upper layer having a top side for supporting the toy vehicle and a lower base. The first section has a first connector, and the second section has a mating second connector. The first and second connectors are connectable so that first and second sections are connectable in an adjacent unit to form an adjacency relationship. Each unit includes a first section and two second sections. Two second sections are located at opposite longitudinal ends of the first section. The first section is bendable in a longitudinal sense substantially parallel to a plane on which a track is directed from one end to the other end in a track running direction. The second section is bendable in a transverse sense substantially transverse to a plane on which a track is directed from one end to the other end in a track running direction.

21 Claims, 8 Drawing Sheets

TOY VEHICLE TRACK SET

BACKGROUND

The present disclosure relates to a bendable toy track.

In a traditional toy vehicle track set, there is usually a track that can be a closed loop track set. It may be constructed by a plural number of straight tracks, curve tracks and uphill/downhill tracks. There can be at least one toy vehicle in which it is either free-wheeling or powered by external or internal engine. Accessories can include bridges, tunnels or columns.

Toy vehicles are popular among children. Frequently, toy vehicles are constructed to run along a toy vehicle track. These vehicle tracks typically have sections of wood, plastic, or metal which are straight or curved and which can be interconnected by the child to form a circuitous toy vehicle track along which a toy vehicle can be rolled on the track.

A problem in a standard curved track is a fixed radius of curvature or as straight. This can be disinteresting to users and a closed loop track can have a finite number of choices of curved sections.

Other structures for interconnecting vehicle tracks that have been used, but generally can be overly complicated or do not provide a mechanism for retaining the vehicle track segments in a selected position of curvature.

Additionally, mechanisms for allowing a toy vehicle track to curve upwards off the surface on which the track is disposed or downward therefrom can be complicated.

There is a need for a toy vehicle track that is simple in construction and allows for flexibility in the connection between adjoining vehicle track sections. This allows the user playing with the track to arrange it in different curvatures as desired while maintaining continuity of the track sections and allowing the track to vary in height.

SUMMARY

An object of the present disclosure is to provide a track for a toy vehicle that allows for bendability in the curvature and connection between adjoining vehicle tracks.

The present disclosure concerns a bendable track. This track can be set up as an uphill/downhill track, a straight track, and a curved or twisted track.

More specifically, the disclosure relates to a bendable track for a toy vehicle having interlinking sections. There is a structure providing for track segments to be angled with respect to adjacent track segments so as to selectively curve the track in three dimensions, namely up and down as well as left and right.

Another object of the present disclosure is to provide a track for a toy vehicle that may be manipulated by the user to form different curvatures and be moved up and down and permit for bendability and twisting.

The above and other objects are fulfilled by the disclosure, which is a track for a toy vehicle and optionally the corresponding vehicle.

DRAWINGS

The above-mentioned features and objects of the present disclosure will become more apparent with reference to the following description taken in conjunction with the accompanying drawings wherein like reference numerals denote like elements and in which.

Figure 7B:
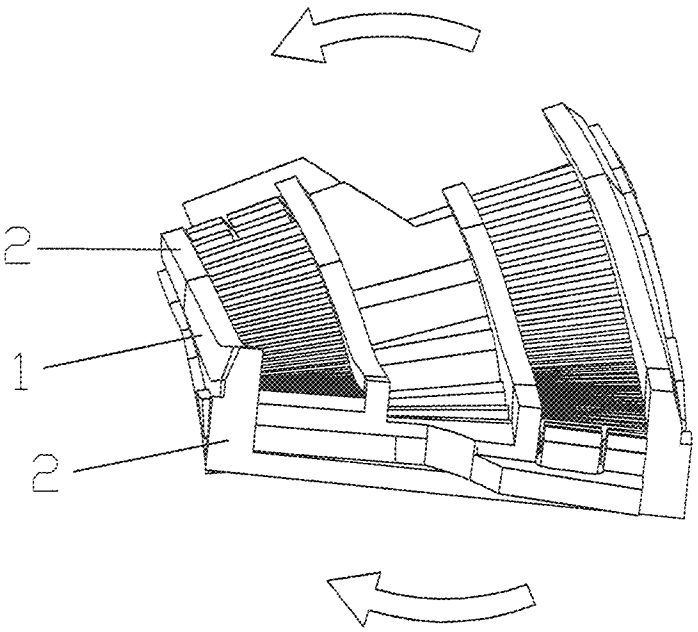
Figure 7A:
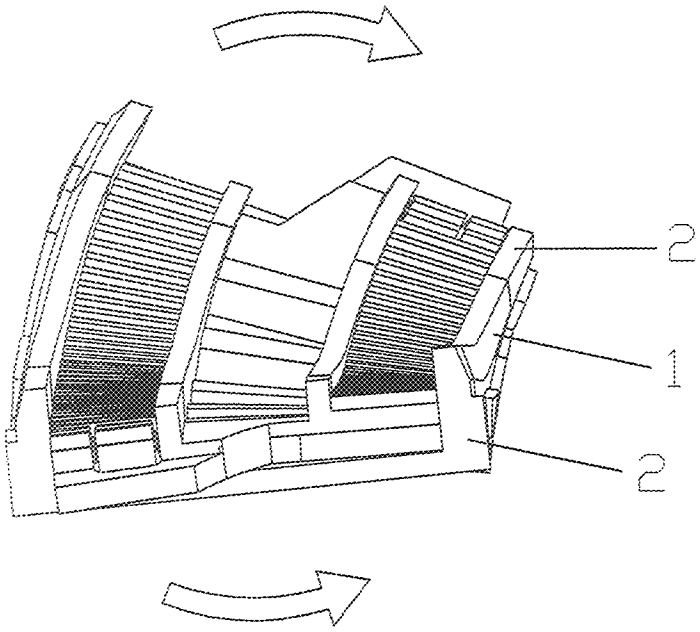

FIG. 7*a* is a perspective view of a twisted bendable track in one direction.

FIG. 7*b* is a perspective view of a twisted bendable track in an opposition direction.

Figure 8:
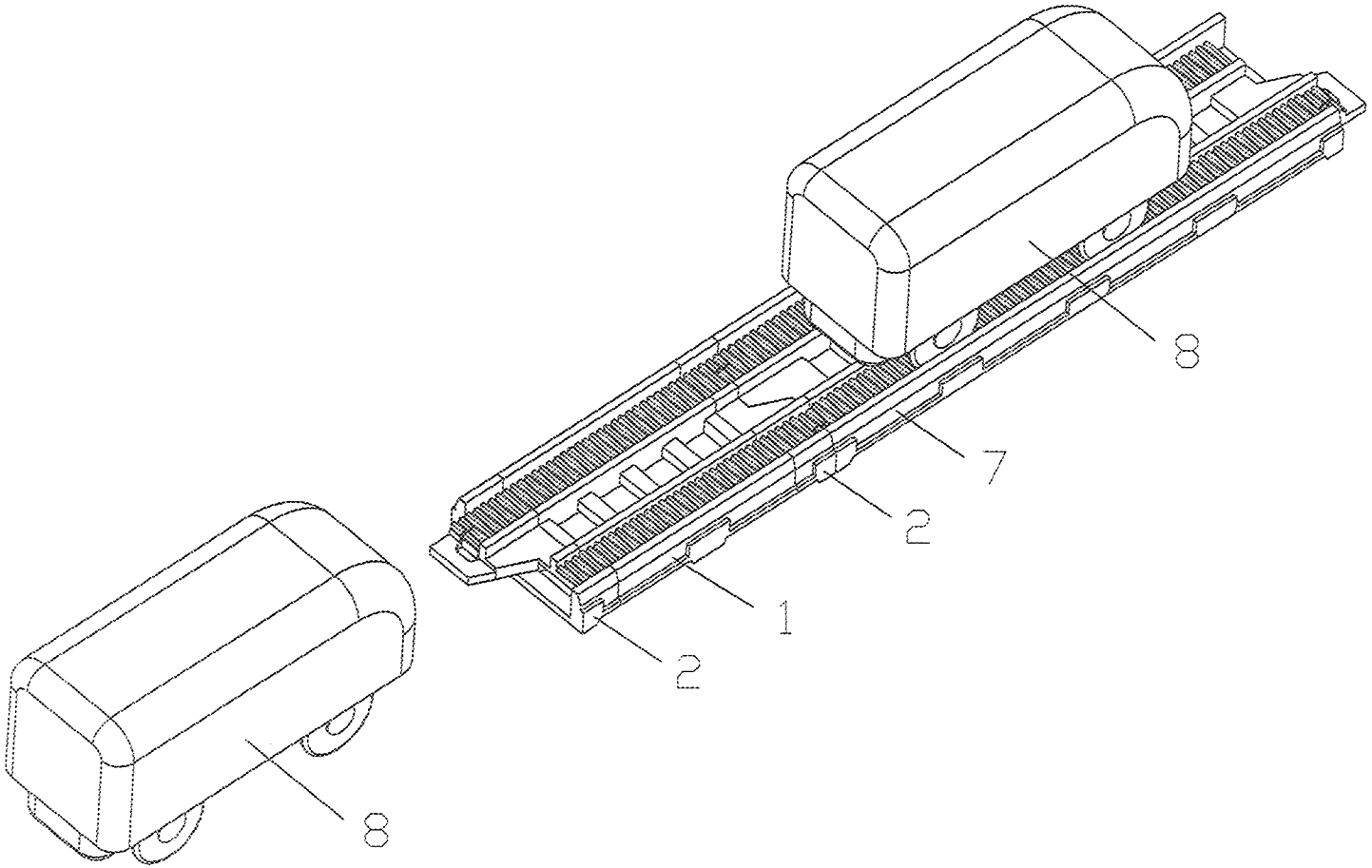

FIG. 8 is a toy vehicle on a bendable track coupled to a straight track.

DETAILED DESCRIPTION

A description of the disclosure is with reference to the attached FIGS. 1-8. It should be noted that these drawings are exemplary in nature and in no way serve to limit the scope of the disclosure, which is defined by the claims appearing herein below.

A track for a toy vehicle having a plurality of connectable adjacent units, each of the adjacent units comprising at least two sections. There is a first section having an upper side for supporting the toy vehicle and a bottom side. A second section has an upper layer having a top side for supporting the toy vehicle and a lower base. The lower base is spaced apart from the upper layer.

The first section has a first connector formed with the first section, and the second section has a mating second connector formed with the second section. The first and second connectors are connectable so that first and second sections are connectable in an adjacent unit to form an adjacency relationship. Each unit includes a first section and two second sections, and the two second sections are located at opposite longitudinal ends of the first section.

The track includes a running direction in a longitudinal direction of the track running direction, and transverse direction from one side of the track to the other side. On each of the units in the transverse direction of the track there are a pair of first connectors and a mating pair of second connectors in lateral adjacency to each other.

The first section is bendable in a longitudinal sense substantially parallel to a plane on which a track is directed from one end to the other end in a track running direction. It is selectively bendable in a transverse sense substantially transverse to a plane on which a track is directed from one end to the other end in a track running direction.

The second section is bendable in a transverse sense substantially transverse to a plane on which a track is directed from one end to the other end in a track running direction.

The track includes a running direction in a longitudinal direction of the track running direction, and transverse direction from one side of the track to the other side, and including at least one base member under the track base, the base member being bendable in a longitudinal sense substantially parallel to a plane on which a track is directed from one end to the other end in the track running direction and being bendable in a longitudinal sense substantially transverse to a plane on which a track is directed from one end to the other end in the track running direction.

The track is formed by two separate longitudinal pathways, and the pathways are connected by transversely spaced cross ribs. The track includes a lock for securing the first section in an adjacent abutment with the second section.

The track includes a first section having an upper side for supporting the toy vehicle and a bottom side; a second section having an upper layer having a top side for supporting the toy vehicle. There is a lower base which is spaced apart from the upper layer.

The second section has a forwardly projecting male tongue attached to at least one of the upper layer or lower base extending from the second section. A female receptor within the upper layer and lower base of the second section. The female receptor is for receiving the male projecting tongue from a second unit. The adjacent units for the track fit with the second section of an adjacent unit to form an adjacency relationship. Selectively, the first section and the second section are formed in a single molding process.

Each unit includes a first section and two second sections. The two second sections are located at opposite longitudinal ends of the first section.

The transverse direction of the track includes the male tongue in lateral adjacency to the female receptor.

There is at least one, and selectively two base members, selectively longitudinally spaced apart under the track base. The base member is bendable in a longitudinal sense substantially parallel to a plane on which a track is directed from one end to the other end in the track running direction.

The track includes a running direction in a longitudinal direction of the track running direction, and transverse direction from one side of the track to the other side, and wherein the track is formed by two separate longitudinal pathways, the pathways being connected by transversely spaced cross ribs.

The track includes a lock for securing the first section in an adjacent abutment with the second section.

The first section has a first connector formed with the first section, and the second section having a mating second connector formed with the second section. The first and second connectors are connectable so that first and second sections are connectable in an adjacent unit to form an adjacency relationship.

Each unit includes a first section and two second sections, the two second sections being located at opposite longitudinal ends of the first section. On each of the adjacent units in the transverse direction of the track there are a pair of first connectors and a mating pair of second connectors in lateral adjacency to each other.

The base member is bendable in a lateral sense substantially parallel to a plane on which a track is directed from one end to the other end in the track running direction. The track is bendable in a longitudinal sense substantially transverse to a plane on which a track is directed from one end to the other end in the track running direction. The base member joins the two second sections so that the first section removably fits between the second sections thereby to form an integrated unit when in a fitted position.

On the second section a first end of the unit, the connector is a pair including a male connector in adjacent lateral crosswise relationship relative with a female connector. On an opposite end of the unit, the second section connector is a pair including a female connector in adjacent lateral crosswise relationship relative with a male connector. The first end the male and female pair in transverse adjacency is opposite to the male and female adjacency on the second end. As such that respective male and female connectors of multiple units are connectable to form an assembled track made of a plurality of connected units.

The first section is formed of an elastic material, selectively a SBS material, and the second section is a bendable material, selectively a thermoplastic polymer.

At least one base member is under the track, and the base member is bendable in a longitudinal sense substantially parallel to a plane on which a track is directed from one end to the other end in the track running direction. The base member is relatively thin in thickness from top to bottom and relative wide transversely from side to side.

Figure 1:
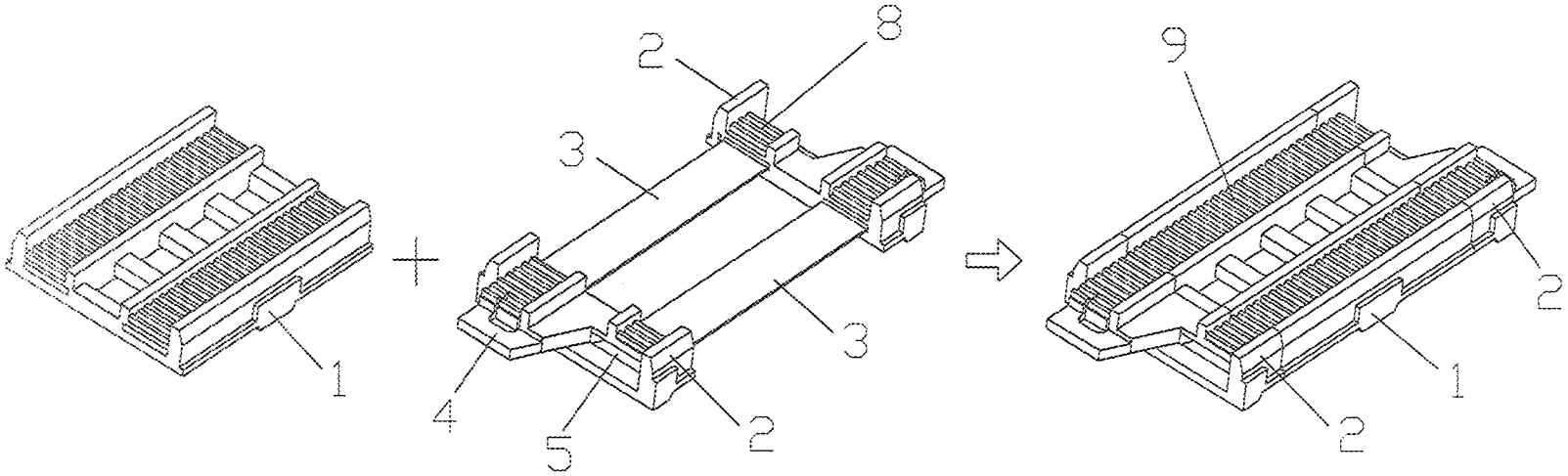
FIG. 1 is a perspective view of bendable track.
Figure 2:
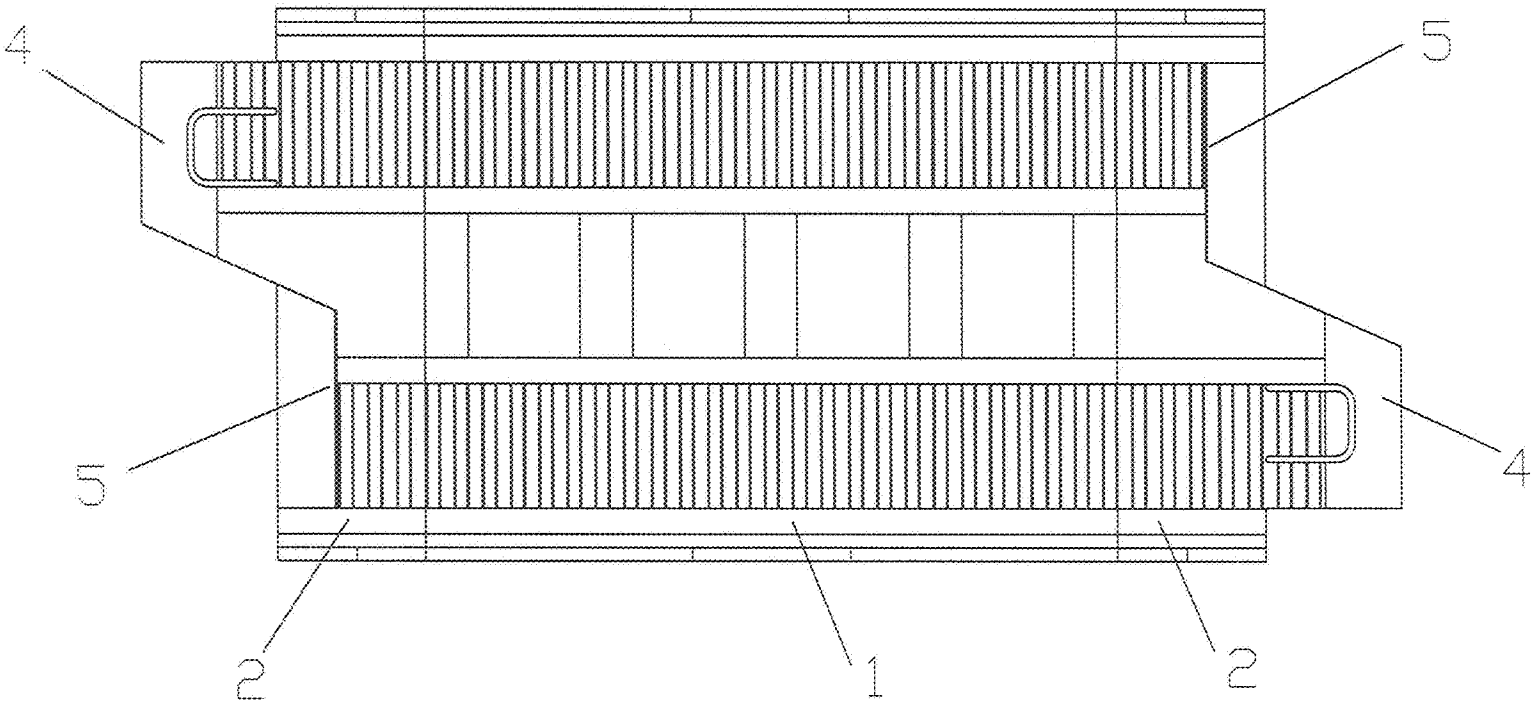
FIG. 2 is a top view of a bendable track.
Figure 3:
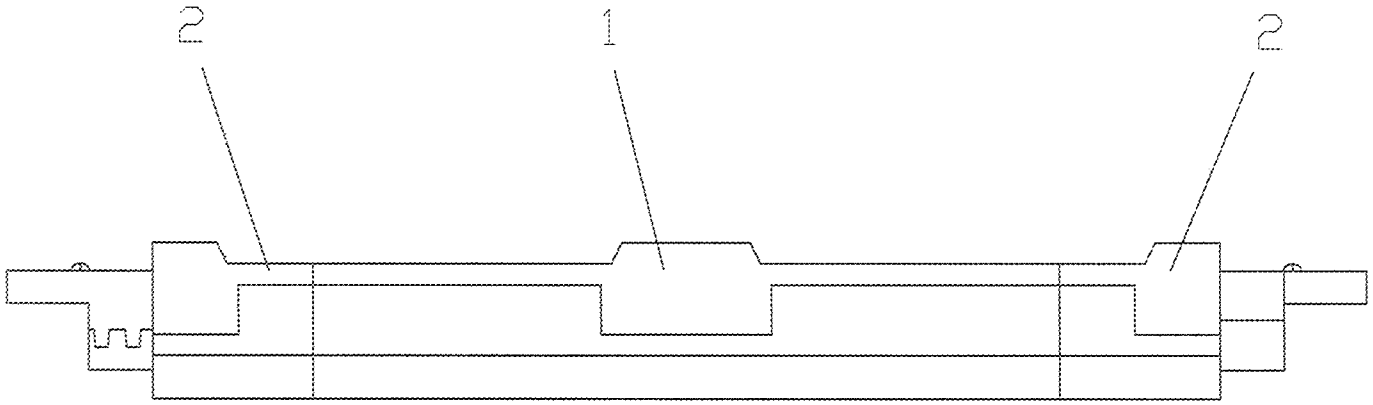
FIG. 3 is a side view of a bendable track.
Figure 4:
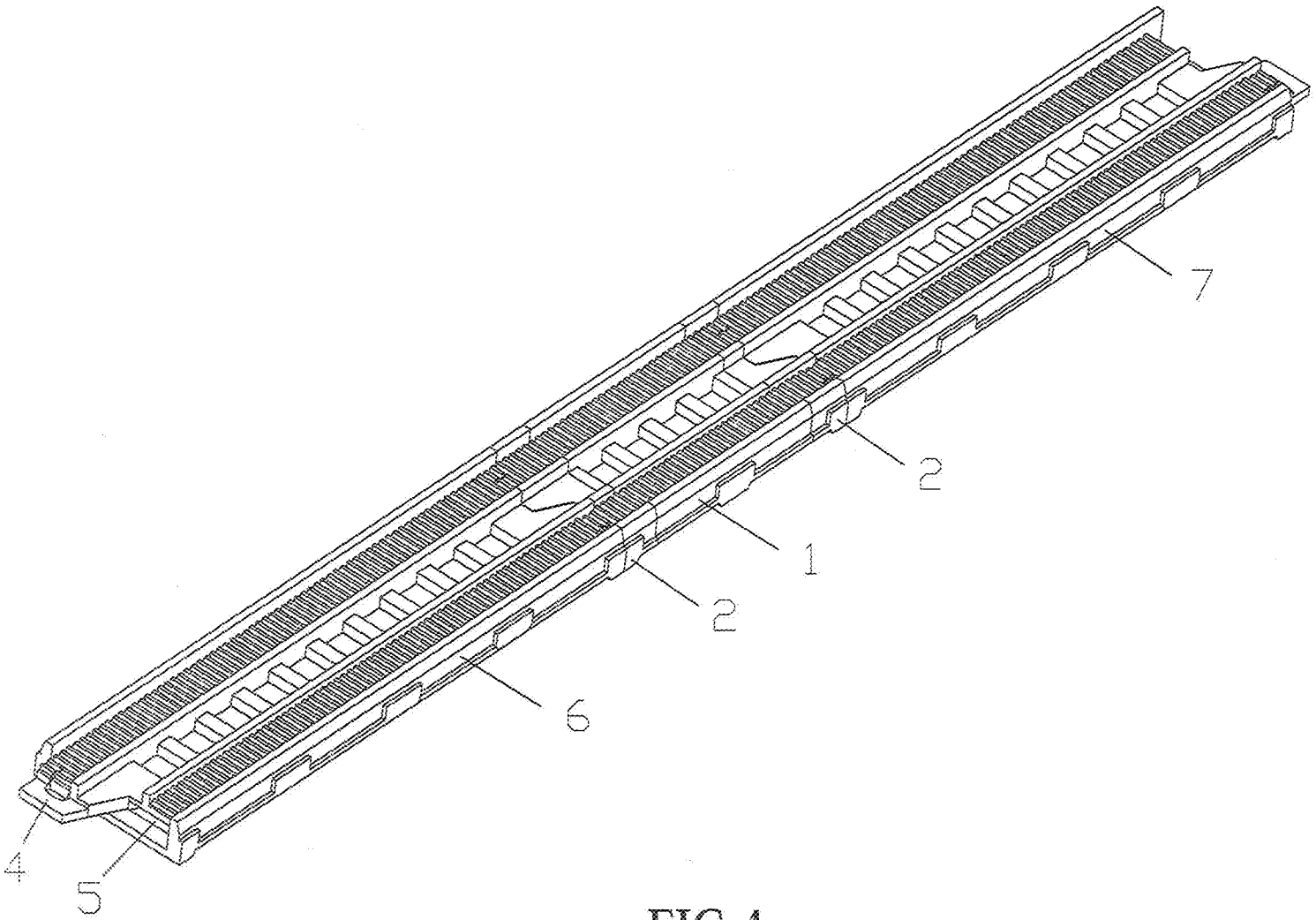
FIG. 4 is a perspective view of bendable track coupled to two straight tracks on a flat surface.
Figure 5:
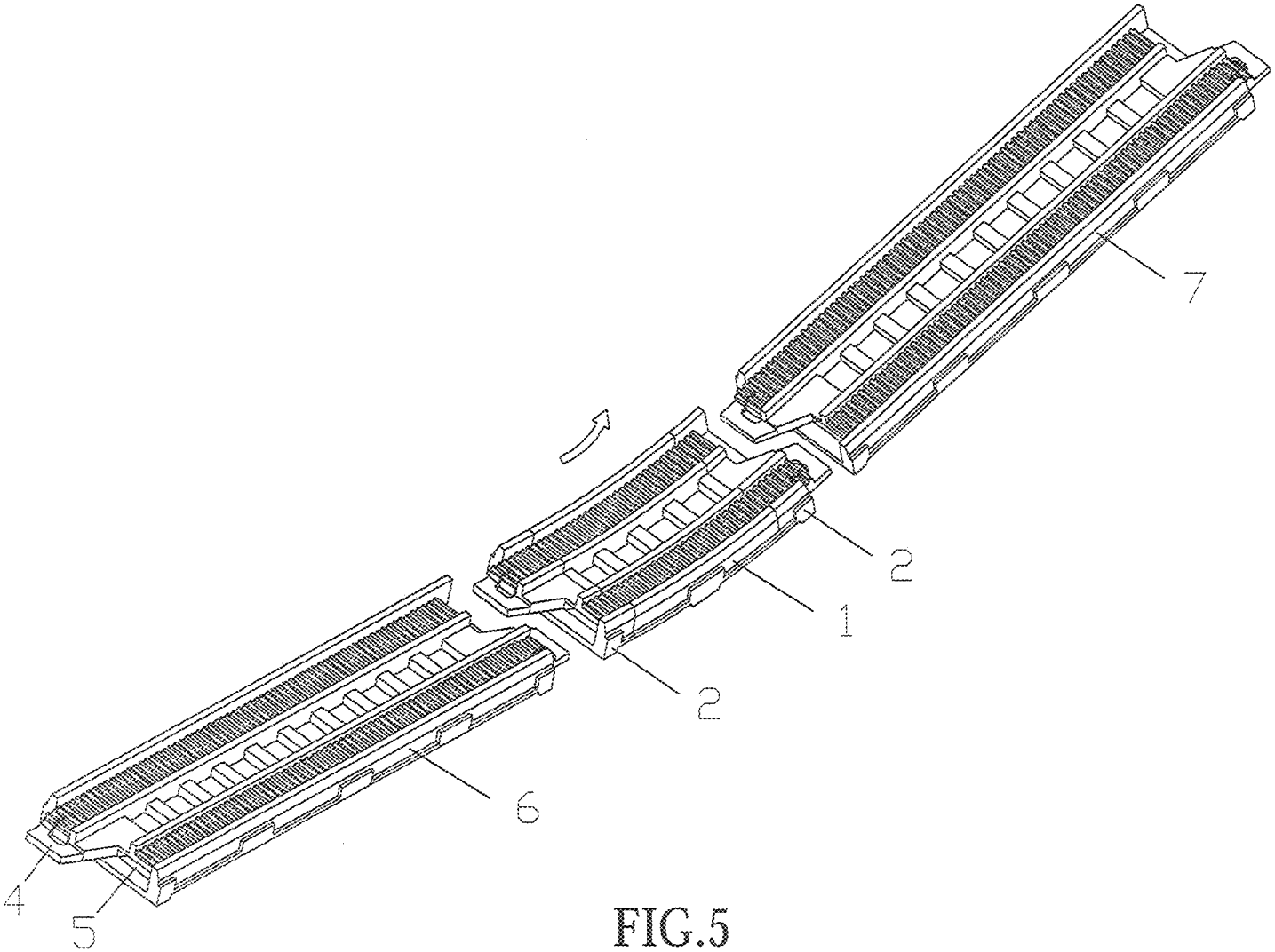
FIG. 5 is a perspective view of bendable track in concave shape coupled to 2 straight tracks in an uphill scenario.
Figure 6:
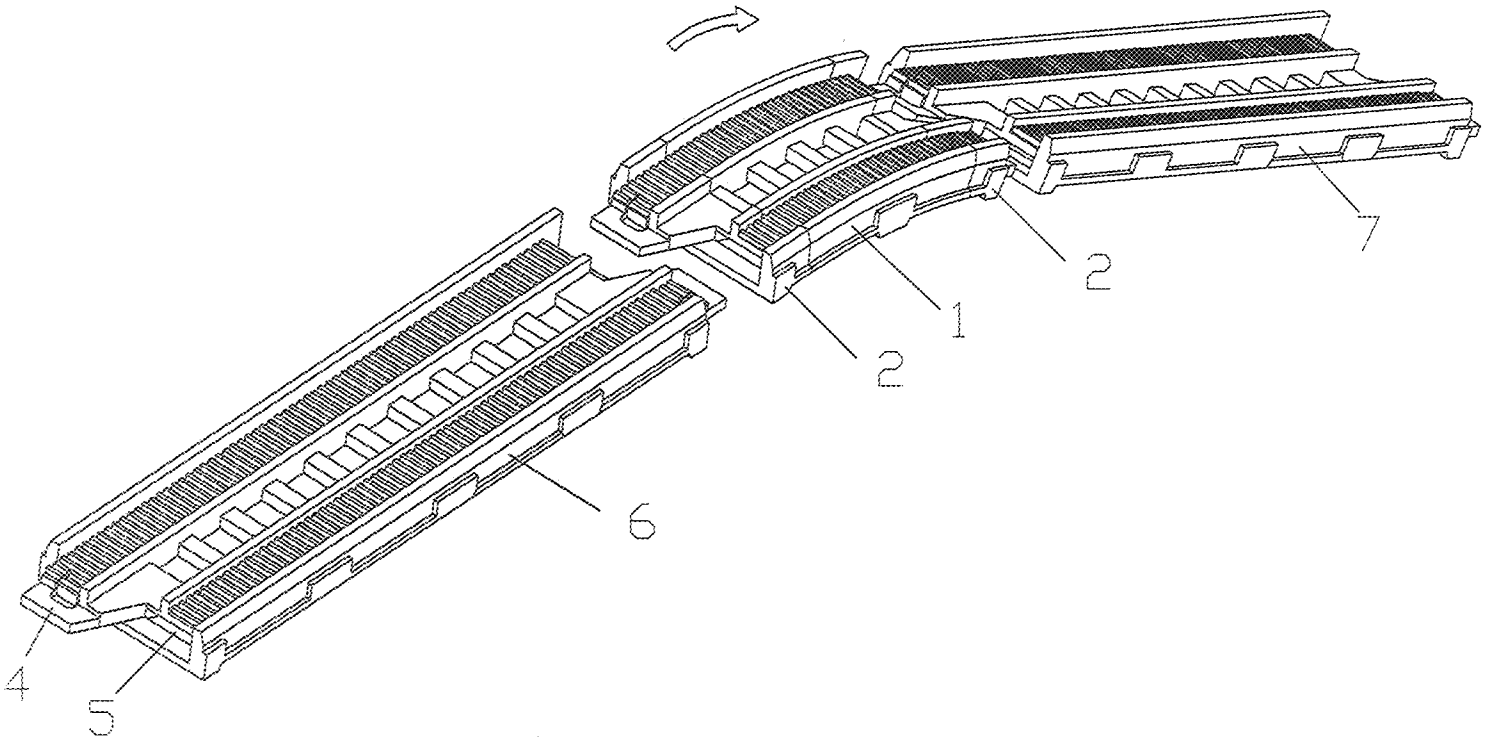
FIG. 6 is a perspective view of bendable track in convex shape coupled to 2 straight tracks in a downhill scenario.

Referring to FIG. 1, the bendable track 9 is formed by two portions. The first section is a bendable track portion 1. This is made of soft material such as rubber or SBS which has good elasticity.

The second section is a bendable track portion 8. This is made of thermoplastic polymer such as PP which has good resistance to fatigue. Part of the second section 8 are a pair of base members, namely linkages 3 under and part of the bendable first portion 1 and linking the opposite ends 8. The linkages are thin from top to bottom, and wide laterally from side to side so that it can be easily twisted along the longitudinal axis. These linkages 8 are formed with holes along their length and they can also be bent along their lateral transverse axis.

The first section can be formed by straight tracks, curved tracks or bendable tracks. To be properly coupled to adjacent straight tracks 6, curved tracks or bendable tracks 9, the second section includes connector modules 2 at both ends of bendable track portion 8. These are relatively thick and hence more solid. The second section further comprises of male connector 4 and female connector 5.

With different combinations of track configuration, players are able to build a close loop track system for the toy vehicle 7.

The disclosed track is bendable laterally and longitudinally in its configuration, and the various units do not flop around loosely. The track retains its shape once set up by the user. The first section and second section structure with respective connectors achieves this. With this mechanism, the track curvature will be substantially stable until the user actively moves a unit or reconstructs the track with respect to adjacent units.

The track can twist and turn. Vehicles 7 are provided such that as a vehicle travels, there are wheels for support on track.

The disclosure is not limited to the above description. For example, it is described above that the units are separate but attachable to both the male and female segments to form a track. It is also contemplated that the disclosed track can be assembled in a variety of sections each having a plurality of units attached to one another.

The disclosed track is capable of being curved into a wide variety of curves, and includes a plurality of connectable units. Each of the units includes an upper layer having a top side for supporting a toy vehicle and a bottom or a lower layer spaced apart from the upper layer.

The disclosure also includes a toy vehicle for use with a track as described above. The disclosed toy vehicle includes a base and wheels adapted to contact the top side of the track to allow the vehicle to roll on the track.

The disclosure also includes a combination track and toy vehicle which may be sold/provided as a set.

While the device, apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims

What is claimed is:

1. A track for a toy vehicle having a plurality of connectable adjacent units, each of the adjacent units comprising at least two sections:

a first section having an upper side for supporting the toy vehicle and a bottom side;

a second section having an upper layer having a top side for supporting the toy vehicle and a lower base; the lower base being spaced apart from the upper layer;

the first section having a first connector formed with the first section, and the second section having a mating second connector formed with the second section;

the first and second connectors being connectable so that first and second sections are connectable in an adjacent unit to form an adjacency relationship, and wherein each unit includes a first section and two second sections, the two second sections being located at opposite longitudinal ends of the first section;

wherein the first section is bendable in a longitudinal sense substantially parallel to a plane on which a track is directed from one end to the other end in a track running direction, the bendability of the first section is variable and is such that the first section can attain and retain multiple different degrees of selected bending, the second section having a forwardly projecting male tongue attached to at least one of the upper layer or lower base extending from the second section;

a female receptor within the upper layer and lower base of the second section;

the female receptor being for receiving the male projecting tongue from a second segment unit such that adjacent segment units for the track fit with the second section of an adjacent unit to form an adjacency relationship, and wherein the track includes a running direction in a longitudinal direction of the track running direction, and transverse direction from one side of the track to the other side, and wherein the track is formed by two separate longitudinal pathways, the pathways being connected by multiple transversely spaced cross ribs, the transverse ribs being at the ends of the tracks and additionally between the ends of track.

2. A track for a toy vehicle according to claim 1, wherein the track includes a running direction in a longitudinal direction of the track running direction, and transverse direction from one side of the track to the other side, and on each of the second units in the transverse direction of the track there are a pair of first connectors and a mating pair of second connectors in lateral adjacency to each other.

3. A track for a toy vehicle according to claim 1, wherein the first section is bendable in a transverse sense substantially transverse to a plane on which a track is directed from one end to the other end in a track running direction.

4. A track for a toy vehicle according to claim 1, wherein the second section is bendable in a transverse sense substantially transverse to a plane on which a track is directed from one end to the other end in a track running direction.

5. A track for a toy vehicle according to claim 1, wherein the track includes a running direction in a longitudinal direction of the track running direction, and transverse direction from one side of the track to the other side, and including at least one base member under the track base, the base member being bendable in a longitudinal sense substantially parallel to a plane on which a track is directed from one end to the other end in the track running direction and being bendable in a longitudinal sense substantially transverse to a plane on which a track is directed from one end to the other end in the track running direction.

6. A track for a toy vehicle according to claim 1, wherein the track includes a running direction in a longitudinal direction of the track running direction, and transverse direction from one side of the track to the other side, and including a lock for securing the first section in an adjacent abutment with the second section, and wherein selectively the first section and the second section are formed in a single molding process.

7. A track for a toy vehicle according to claim 1, and the connector members for connecting adjacent track unit being bendable thereby to facilitate the bending between adjacent connected tracks units.

8. A track for a toy vehicle according to claim 1, wherein the multiple ribs between the ends are transversely relatively movable to be closer together or further apart according to the degree of transverse bending of the track unit.

9. A track for a toy vehicle having a plurality of connectable adjacent units, each of the adjacent units comprising at least two sections:

a first section having an upper side for supporting the toy vehicle and a bottom side;

a second section having an upper layer having a top side for supporting the toy vehicle and a lower base; the lower base being spaced apart from the upper layer;

the second section having a forwardly projecting male tongue attached to at least one of the upper layer or lower base extending from the second section;

a female receptor within the upper layer and lower base of the second section;

the female receptor being for receiving the male projecting tongue from a second segment unit such that adjacent segment units for the track fit with the second section of an adjacent unit to form an adjacency relationship, wherein the first section is bendable in a longitudinal sense substantially parallel to a plane on which a track is directed from one end to the other end in a track running direction, the bendability of the first section is variable and is such that the first section can attain and retain multiple different degrees of selected bending, and wherein the track includes a running direction in a longitudinal direction of the track running direction, and transverse direction from one side of the track to the other side, and wherein the track is formed by two separate longitudinal pathways, the pathways being connected by transversely spaced cross ribs the pathways being connected by multiple transversely spaced cross ribs, the transverse ribs being at the ends of the tracks and additionally between the ends of track.

10. A track for a toy vehicle according to claim 9 wherein each unit includes a first section and two second sections, the two second sections being located at opposite longitudinal ends of the first section.

11. A track for a toy vehicle according to claim 9, wherein the track includes a running direction in a longitudinal direction of the track running direction, and transverse direction from one side of the track to the other side, and on each of the units in the transverse direction of the track the male tongue in lateral adjacency to the female receptor.

12. A track for a toy vehicle according to claim 9, wherein the second section is bendable in a transverse sense substantially transverse to a plane on which a track is directed from one end to the other end in a track running direction.

13. A track for a toy vehicle according to claim 9, wherein the track includes a running direction in a longitudinal direction of the track running direction, and transverse direction from one side of the track to the other side, and including at least one base member under the track base, the base member being bendable in a longitudinal sense substantially parallel to a plane on which a track is directed from one end to the other end in the track running direction and the second section is bendable in a substantially transverse sense relative to a plane on which a track is directed from one end to the other end in the track running direction.

14. A track for a toy vehicle according to claim 9, wherein the track includes a running direction in a longitudinal direction of the track running direction, and transverse direction from one side of the track to the other side, and including a lock for securing the first section in an adjacent abutment with the second section.

15. A track for a toy vehicle having a plurality of connectable adjacent units, each of the adjacent units comprising at least two sections:

a first section having an upper side for supporting the toy vehicle and a bottom side;

a second section having an upper layer having a top side for supporting the toy vehicle and a lower base; the lower base being spaced apart from the upper layer;

the first section having a first connector formed with the first section, and the second section having a mating second connector formed with the second section;

the first and second connectors being connectable so that first and second sections are connectable in an adjacent unit to form an adjacency relationship, and wherein each unit includes a first section and two second sections, the two second sections being located at opposite longitudinal ends of the first section, wherein the track includes a running direction in a longitudinal direction of the track running direction, and transverse direction from one side of the track to the other side, and on each of the adjacent units in the transverse direction of the track there are a pair of first connectors and a mating pair of second connectors in lateral adjacency to each other, wherein in each of the adjacent unit, the first section is bendable in a longitudinal sense substantially parallel to a plane on which a track is directed from one end to the other end in a track running direction, wherein the second section is bendable in a transverse sense substantially transverse to a plane on which a track is directed from one end to the other end in a track running direction, and wherein the track includes a running direction in a longitudinal direction of the track running direction, and transverse direction from one side of the track to the other side, and wherein the track is formed by two separate longitudinal pathways, the pathways being connected by transversely spaced cross ribs the pathways being connected by multiple transversely spaced cross ribs, the transverse ribs being at the ends of the tracks and additionally between the ends of track.

16. A track for a toy vehicle according to claim 15, wherein the track includes a running direction in a longitudinal direction of the track running direction, and transverse direction from one side of the track to the other side, and including at least one base member under the track, the base member being bendable in a lateral sense substantially parallel to a plane on which a track is directed from one end to the other end in the track running direction and being bendable in a longitudinal sense substantially transverse to a plane on which a track is directed from one end to the other end in the track running direction, the base member joining the two second sections so that the first section removably fits between the second sections thereby to form an integrated unit when in a fitted position and wherein selectively the first section and the second section are formed in a single molding process the bendability of the first section is variable and is such that the first section can attain and retain multiple different degrees of selected bending.

17. A track for a toy vehicle according to claim 15, wherein on the second section a first end of the unit, the connector is a pair including a male connector in adjacent lateral crosswise relationship relative with a female connector, and wherein on the an opposite end of the unit, the second section connector is pair including a female connector in adjacent lateral crosswise relationship relative with a male connector, such that on the first end the male and female pair in transverse adjacency is opposite to the male and female adjacency on the second end and as such that respective male and female connectors of multiple units are connectable to form an assembled track made of a plurality of connected units, the bendability of the first section is variable and is such that the first section can attain and retain multiple different degrees of selected bending.

18. A track for a toy vehicle according to claim 15, wherein the first section is formed of an elastic material, selectively a rubber or SBS material, and the second section is a bendable material, selectively a thermoplastic polymer, the bendability of the first section is variable and is such that the first section can attain and retain multiple different degrees of selected bending.

19. A track for a toy vehicle according to claim 15, including at least one base member under the track, the base member being bendable in a longitudinal sense substantially parallel to a plane on which a track is directed from one end to the other end in the track running direction and second section being bendable in a transverse sense substantially transverse to a plane on which a track is directed from one end to the other end in the track running direction, the base member being relatively thin in thickness from top to bottom and relative wide transversely from side to side the bendability of the first section is variable and is such that the first section can attain and retain multiple different degrees of selected bending.

20. A track for a toy vehicle having a plurality of connectable adjacent units, each of the adjacent units comprising at least two sections:

a first section having an upper side for supporting the toy vehicle and a bottom side;

a second section having an upper layer having a top side for supporting the toy vehicle and a lower base; the lower base being spaced apart from the upper layer;

the first section having a first connector formed with the first section, and the second section having a mating second connector formed with the second section;

the first and second connectors being connectable so that first and second sections are connectable in an adjacent unit to form an adjacency relationship, and wherein each unit includes a first section and two second sections, the two second sections being located at opposite longitudinal ends of the first section;

wherein the first section is bendable in a longitudinal sense substantially parallel to a plane on which a track is directed from one end to the other end in a track running direction, the second section having a forwardly projecting male tongue attached to at least one of the upper layer or lower base extending from the second section;

a female receptor within the upper layer and lower base of the second section;

the female receptor being for receiving the male projecting tongue from a second segment unit such that adjacent segment units for the track fit with the second section of an adjacent unit to form an adjacency relationship, and the connector members for connecting adjacent track unit being bendable thereby to facilitate the bending between adjacent connected tracks units.

21. A track for a toy vehicle having a plurality of connectable adjacent units, each of the adjacent units comprising at least two sections:

a first section having an upper side for supporting the toy vehicle and a bottom side;

a second section having an upper layer having a top side for supporting the toy vehicle and a lower base; the lower base being spaced apart from the upper layer;

the first section having a first connector formed with the first section, and the second section having a mating second connector formed with the second section;

the first and second connectors being connectable so that first and second sections are connectable in an adjacent unit to form an adjacency relationship, and wherein each unit includes a first section and two second sections, the two second sections being located at opposite longitudinal ends of the first section;

wherein the first section is bendable in a longitudinal sense substantially parallel to a plane on which a track is directed from one end to the other end in a track running direction, the bendability of the first section is variable and is such that the first section can attain and retain multiple different degrees of selected bending, the second section having a forwardly projecting male tongue attached to at least one of the upper layer or lower base extending from the second section;

a female receptor within the upper layer and lower base of the second section; and the female receptor being for receiving the male projecting tongue from a second segment unit such that adjacent segment units for the track fit with the second section of an adjacent unit to form an adjacency relationship, and wherein the track includes a running direction in a longitudinal direction of the track running direction, and transverse direction from one side of the track to the other side, and wherein the track is formed by two separate longitudinal pathways, the pathways being connected by a transversely spaced cross rib, the transverse rib being located in a position inset and removed from the ends of track.

* * * * *